US011982142B2

(12) United States Patent
Otaibi

(10) Patent No.: US 11,982,142 B2
(45) Date of Patent: May 14, 2024

(54) METHOD AND APPARATUS OF SMART PRESSURES EQUALIZER NEAR BIT SUB

(71) Applicant: SAUDI ARABIAN OIL COMPANY, Dhahran (SA)

(72) Inventor: Mohammed M. Otaibi, Dammam (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 287 days.

(21) Appl. No.: 17/455,818

(22) Filed: Nov. 19, 2021

(65) Prior Publication Data

US 2023/0160270 A1 May 25, 2023

(51) Int. Cl.

| | |
|---|---|
| ***E21B 21/08*** | (2006.01) |
| ***E21B 21/10*** | (2006.01) |
| ***E21B 34/10*** | (2006.01) |
| ***E21B 34/16*** | (2006.01) |

(52) U.S. Cl.

CPC ..... *E21B 21/08* (2013.01); *E21B 21/10* (2013.01); *E21B 34/10* (2013.01); *E21B 34/16* (2013.01)

(58) Field of Classification Search

CPC ..... E21B 21/08; E21B 21/10; E21B 34/10; E21B 34/16

See application file for complete search history.

(56) References Cited

U.S. PATENT DOCUMENTS

| | | | | |
|---|---|---|---|---|
| 3,729,986 | A * | 5/1973 | Leonard | E21B 21/08 73/152.34 |
| 6,102,673 | A | 8/2000 | Mott et al. | |
| 7,395,878 | B2 | 7/2008 | Reitsma et al. | |
| 7,644,771 | B2 | 1/2010 | Bussear | |
| 7,703,513 | B2 | 4/2010 | Vinegar et al. | |
| 7,798,249 | B2 | 9/2010 | Tibbitts | |
| 9,976,387 | B2 * | 5/2018 | Bisset | E21B 34/102 |
| 10,294,741 | B2 * | 5/2019 | Lewis | E21B 47/06 |
| 2015/0308205 | A1 * | 10/2015 | Arnt | E21B 21/103 175/5 |

FOREIGN PATENT DOCUMENTS

| | | | |
|---|---|---|---|
| EP | 0149290 | A2 | 7/1985 |

OTHER PUBLICATIONS

Uduak Mme and Pål Skalle, "Effects of Mud Properties, Hole size, Drill String Tripping Speed and Configurations on Swab and Surge Pressure Magnitude during Drilling Operations", International Journal of Petroleum Science and Technology; vol. 6; No. 2; 2012; pp. 143-152 (10 pages).

(Continued)

*Primary Examiner* — Nicole Coy

(74) *Attorney, Agent, or Firm* — Osha Bergman Watanabe & Burton LLP

(57) ABSTRACT

A system for well control during tripping phases in drilling operations in a wellbore, the system comprising: a drill string extending from an entry of the wellbore to a drill bit at a distal end of the drill string within the wellbore; a near bit sub mounted along the drill string adjacent to the drill bit; a first smart multi-directional two-way check valve mounted along the drill string adjacent to the near bit sub; and a controller configured to operate the valve. The controller controls the valve to apply suction or discharge flow to the near bit sub to counter inertial effects of drilling mud viscosity within the wellbore.

19 Claims, 5 Drawing Sheets

(56) References Cited

OTHER PUBLICATIONS

Mahmoud Khalifeh and Arild Saasen, "Introduction to Permanent Plug and Abandonment of Wells", Ocean Engineering & Oceanography; vol. 12; 2020 pp. 1-285 (285 pages).
"Step By Step How To Run Drilling Surging / Swabbing Pressure Calculation;" Dec. 12, 2017; pp. 1-18; Retrieved from the Internet: URL: https://www.drillingmanual.com/2017/12/surge-and-swap-pressure-calculations.html (18 pages).
Pattillo, P.D., "Elements of Oil and Gas Well Tubular Design;" Elsevier; Chapter 13; 2018; pp. 395-435 (41 pages).

* cited by examiner

METHOD AND APPARATUS OF SMART PRESSURES EQUALIZER NEAR BIT SUB

BACKGROUND OF INVENTION

FIG. 1 shows a wellbore schematic. The wellbore schematic embodies a drilling rig (100), a drill string (102), a drill bit (104), and a formation (106). The drilling rig (100) is an integrated system that houses equipment to drill wells. The drill string (102) is a column of drill pipe that transmits drilling fluid and torque to the drill bit (104). The drill string (102) can be of any type of material that houses drill collars (202), drill bits (104), and tools. The drill bit (104) is the cutting tool that is most commonly attached to the end of the downhole equipment used for creating a hole in the earth. While cutting rock with the drill bit (104), mud is pumped into the drill string (102). The formation (106) may be any formation in the earth that can be drilled for extracting hydrocarbons, water, or gas. During such operations, issues of well control and management arise involving cases of surging and swabbing. Inertial effects of the mud viscosity in the wellbore are created by the surging and swabbing and may disrupt the drilling operations. Mud viscosity describes the resistance of flow for the substance.

During drilling operations, tripping is a process that is commonly done due to the drill bit conditions affecting the efficiency of drilling. Tripping is the act of pulling the drill string out of the hole or replacing it in the hole. As the drill pipe is pulled from the well, mud may flow down the annulus to fill the void left by the pipe. Removing the drill pipe at rates that create large swab pressures can induce a kick by lowering the wellbore pressure below formation pressure which may lead to a well control issue. It is well known in the industry that swabbing is a recognized hazard of any type of degree volume. As recognized in the industry, most professionals agree that the drill string during tripping may need to be pulled quickly in order to prevent breakage and loss of equipment.

As the drill pipe is lowered into the well, mud is forced out of the flow line causing surge pressure changes. Surge pressures increase the total wellbore pressure and can cause formation fracturing and lost circulation. The reduction of hydrostatic pressure through loss of drilling fluid to the formation may cause the height of the mud column to be shortened affecting a decrease of pressure on the bottom in the hole initiating a kick.

SUMMARY OF INVENTION

In one aspect, one or more embodiments relate to a system for well control during tripping phases in drilling operations in a wellbore, the system comprising: a drill string extending from an entry of the wellbore to a drill bit at a distal end of the drill string within the wellbore; a near bit sub mounted along the drill string adjacent to the drill bit; a first smart multi-directional two-way check valve mounted along the drill string adjacent to the near bit sub; and a controller configured to operate the valve, wherein the controller controls the valve to apply suction or discharge flow to the near bit sub to counter inertial effects of drilling mud viscosity within the wellbore.

In one aspect, one or more embodiments relate to a method, comprising: controlling, by a controller, a smart multi-directional two-way check valve for tripping phases during drilling, wherein the tripping phases comprise of surging effects; controlling, by a controller, a smart multi-directional two-way check valve for tripping phases during drilling, wherein the tripping phases comprise of swabbing effects; applying, by the valve, suction to counter inertial effects of mud viscosity in a wellbore; and applying, by the valve, discharge flow to counter inertial effects of mud viscosity in a wellbore.

In one aspect, one or more embodiments relate to a method for well control during tripping phases in drilling operations using a drill string extending from an entry of a wellbore to a drill bit at a distal end of the drill string within the wellbore, the method comprising: mounting a near bit sub along the drill string adjacent to the drill bit; mounting a first smart multi-directional two-way check valve along the drill string adjacent to the near bit sub; and controlling, by a controller, operation of the valve to apply suction or discharge flow to the near bit sub to counter inertial effects of drilling mud viscosity within the wellbore.

Other aspects and advantages of the invention will be apparent from the following description and the appended claims.

BRIEF DESCRIPTION OF DRAWINGS

Specific embodiments of the disclosed technology will now be described in detail with reference to the accompanying figures. Like elements in the various figures are denoted by like reference numerals for consistency.

DETAILED DESCRIPTION

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as using the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

Figure 1:
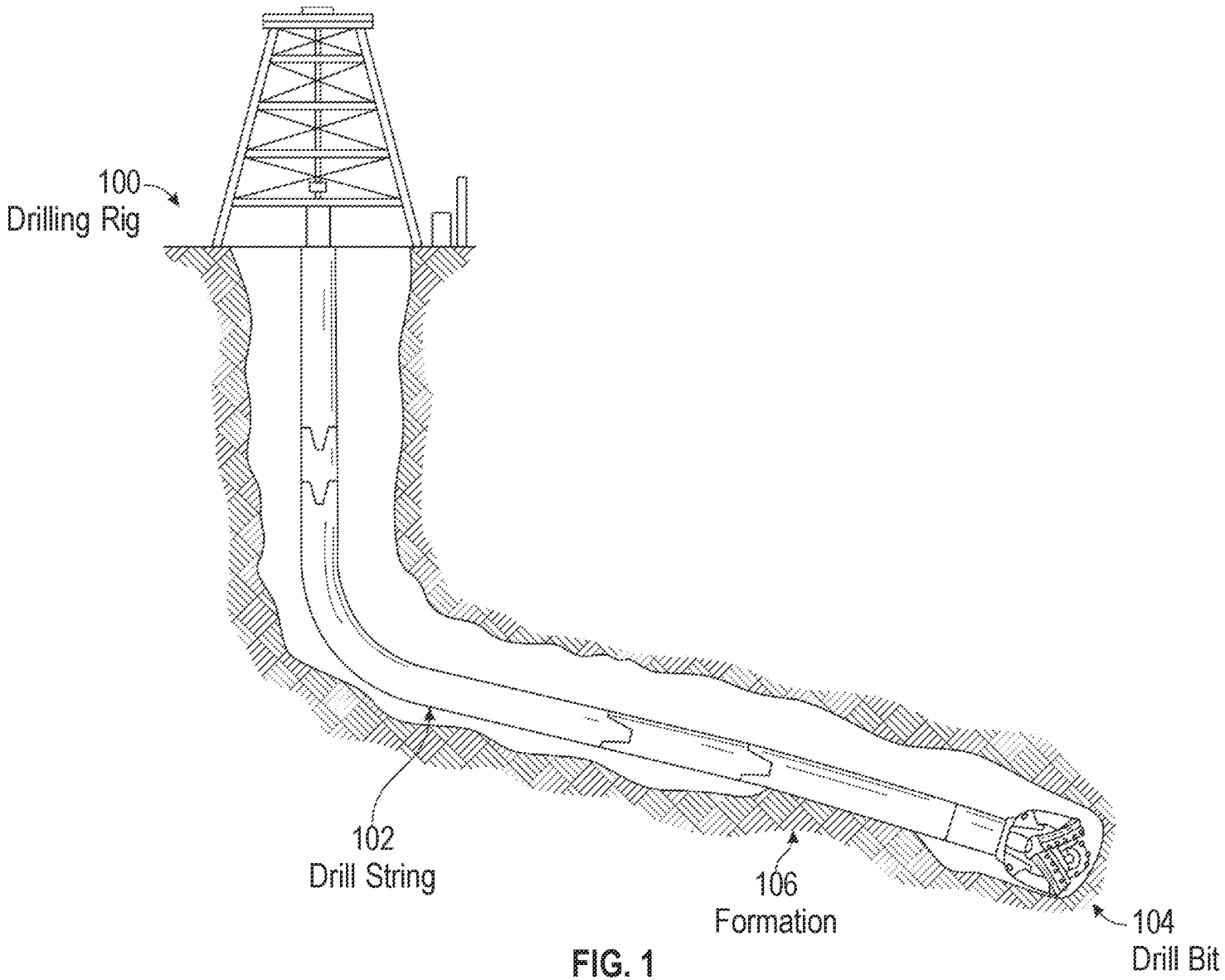
FIG. 1 depicts a well bore schematic in accordance with one or more embodiments.
Figure 2A:
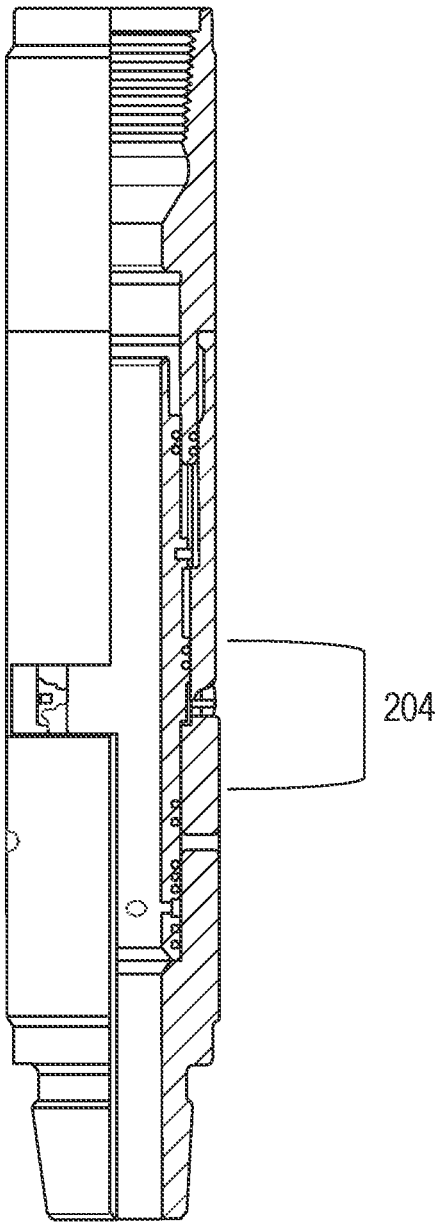
FIGS. 2A-2B shows downhole equipment in accordance with one or more embodiments.
Figure 2B:
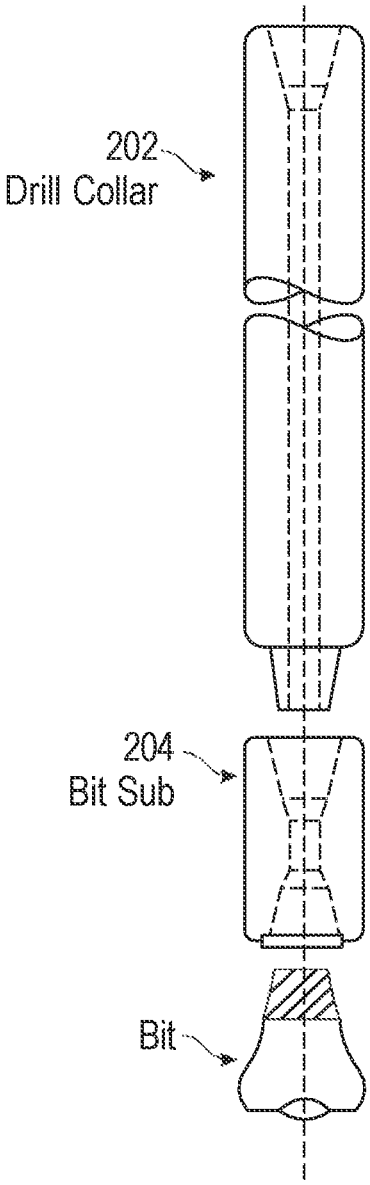

FIGS. 2A-2B show downhole equipment in accordance with one or more embodiments. The near bit sub (204) can be any annulus between the drill collar (202) and the drill bit (104). Drill collars (202) are commonly used at the bottom of the drill string (102) above the drill bit (104). Drill collar (202) may be any component of a drill string that provides weight on drill bit (104) for drilling. This is only one example of how the equipment is placed downhole.

Figure 3:
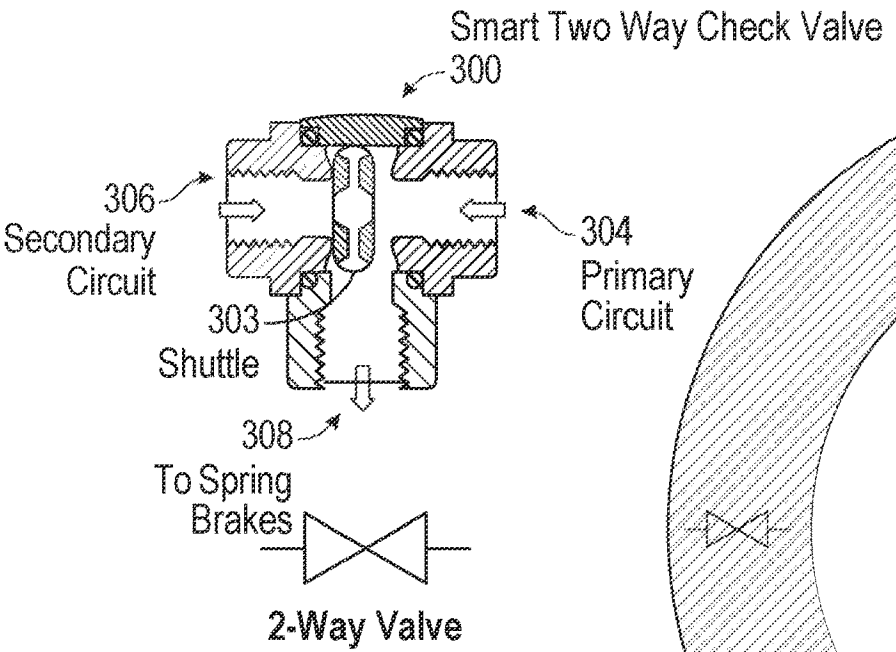
FIG. 3 shows a cross section of a two way check valve schematic in accordance with one or more embodiments.

FIG. 3 shows a cross section of a smart two-way check valve in accordance to one or more embodiments. The valve (300) embodies a shuttle (303), primary inlet (304), secondary inlet (306), and an outlet (308). The shuttle (303) may be any solid that can be used to move between the primary inlet (304), the secondary inlet (306), and the outlet (308). The valve (300) may be designed where that when the shuttle (303) is in the median position, there is flow through the primary inlet (304), secondary inlet (306), and the outlet (308). The shuttle (303) may have room to move between the primary inlet (304) and the secondary inlet (306). The shuttle (303) aides in temporarily closing to prevent passage of flow. The shuttle (303) operates during normal operations of drilling fluid. Passage of flow may be referencing the annular mud flow down the drill string (102) that normally is forced out of the well during drill string movement (102). The mud may flow back up to the surface in an annular space.

The primary inlet (304) may be one side of the multi-directional aspect of the valve (300). The primary inlet (304) may be an entrance to flow into the valve (300). The secondary inlet (306) may be an entrance of flow into the valve (300). For example, there can be fluid or another type of flow that enters both the primary inlet (304) and the secondary inlet (306). The outlet (308) may contain the flow from either the primary inlet (304) or the secondary inlet (306). The valve (300) may be a device that only allows flow through one direction preventing backflow. Backflow may be any unwanted flow of fluids running in the reverse direction. Backflow of cuttings, fluid, debris, or gas into the drill string (102) may plug the equipment and cause damage. This is only one example of backflow.

Figure 4:
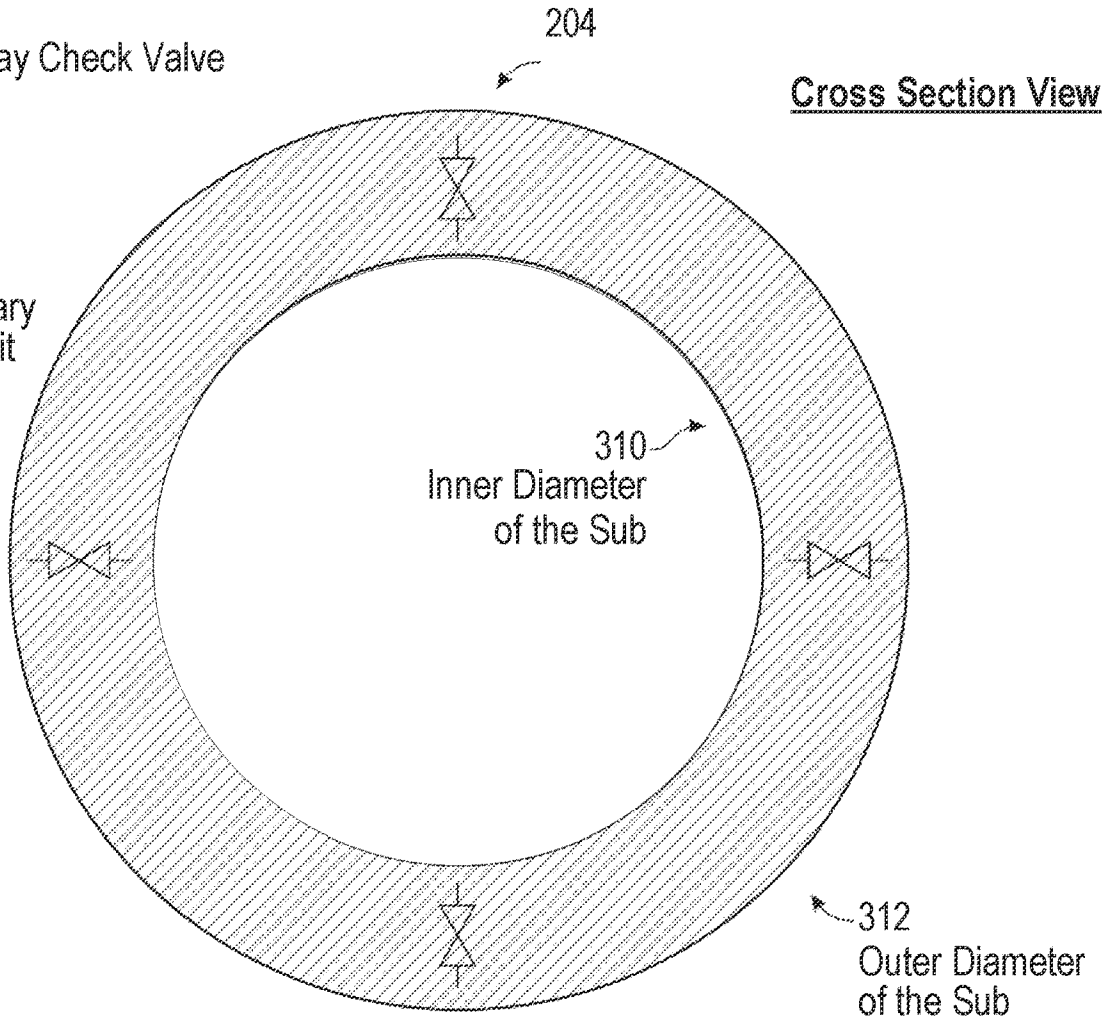
FIG. 4 shows a cross section view of a near bit sub in accordance with one or more embodiments.

FIG. 4 shows the valve (300) may be placed in near bit sub (204) specifically between the inner diameter (310) and outer diameter (312). The inner diameter (310) is commonly the distance from one point of the inner wall of the near bit sub (204) through its center, to an opposite point also on the inside of the near bit sub (204). The outer diameter (312) is commonly the distance of the outside edges of the pipe through its center. FIG. 4 shows four valves placed in the near bit sub (204) 90 degrees apart, however, there could be one or more valves distributed at different angles in the near bit sub (204). The valves (300) may face the wall of the wellbore.

The valve(s) (300) may be activated by applying them in different directions. The valve(s) can be adjusted based on the operation pressure. The valve allows the release and suction of inner pressure. Drilling fluids may cause pressure that is an example of inner pressure.

Figure 5:
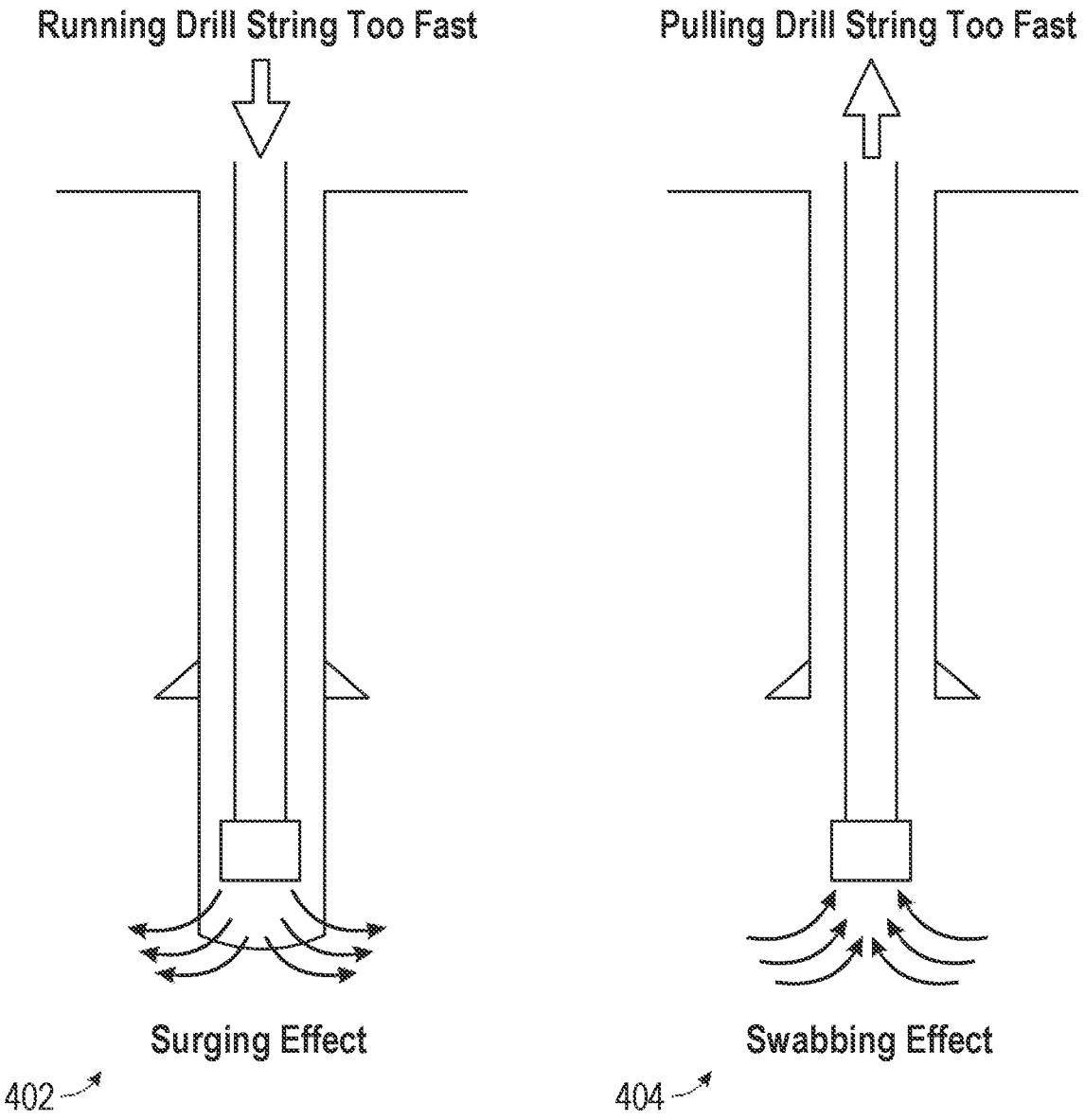
FIG. 5 shows the effects of tripping in a drill string in accordance with one or more embodiments.

FIG. 5 shows effects of tripping in a drill string (102) in accordance with one or more embodiments. During tripping operations, the drill string (102) is moved up and down through the borehole. For example, during tripping operations, the drill string (102) may be run too fast or may be pulled too fast. FIG. 4 depicts the effects of running the drill string (102) too fast called surging (402) and the effects of pulling the drill string (102) too fast called swabbing (404). This is only an example of how the kicks can occur. Running the drill string (102) too fast may be the action of pushing the drill string (102) into the hole. Pulling the drill string (102) too fast may be the action of pulling the drill string (102) out of the hole. Surging effect (402) may occur when the bottom hole pressure is increased as the drill string (102) moves downward. Surging effect (402) may create forces that slow down the motion of the drill string (102). Swabbing effect (404) may occur when bottom hole pressure is reduced as the drill string (102) is pulled upwards allowing an influx of formation fluids into the wellbore. If the swab pressures are large enough, these forces can reduce the mud hydrostatic pressure below the formation pressure and cause a kick. Surging effect (402) and swabbing effect (404) may cause issues including formation or equipment breaking, loss of operational time, and high costs.

The valves (300) may function as suction or discharge nozzles in order to suck or discharge fluids from or into the formation in case of surging effects (402) and swabbing effects (404). The valves (300) may counter the inertial effects of the mud viscosity in the wellbore. The valves (300) may be activated by shear pressure or a controller. A plug aides in countering the inertial effects of the mud viscosity in the wellbore. The plug drops through the drill string (102) and sits at the end of the near bit sub (204). The plug closes the valve(s) and this action isolates the drill string (102) from the formation flow and allows flow from the bit nozzles.

For example, when the pressure is equalized and valves (300) are activated, a plug is sent through high pressure to be seated in a median position between the valves (300) and blocks the way in and out. The plug is designed to be pushed until the seat near the valve system. Once the plug is seated in its place, the plug may receive a higher pressure in order to break the membrane and open the hole in the middle to allow normal string operations through the plug. In this disclosure, the plug can be designed with a hollow center and covered with a polymer seal. The plug may be covered with any type of material that can be considered a seal to allow the plug to be pushed to suction and release. The plug may be of a blind calendrical shape closed from one side. The plug must be able to allow full access to the drilling bit with closed valves (300) around the near bit sub (204). This action can be triggered by applying additional pressure by the drilling fluids.

The valve (300) may be activated depending on returning data feed based on commands from the well control room on the rig. The commands from the well control room may include but not limited to number of barrels versus pumped barrels, comparing pressure in versus out, and commands from multiple sources of data. An example of a command could be "valves are not activated." The valve (300) redirects the flow of fluid appropriately, which creates suction or discharge. Suction may be controlled by the valve (300) closing the primary inlet (304) or secondary inlet (306). Discharge may be controlled by the valve (300) opening the primary inlet (304), secondary inlet (306), and outlet (308). The valve (300) can be activated based on the pressure build up. The valve (300) may be activated based on the action performed during the drilling operation.

Figure 6:
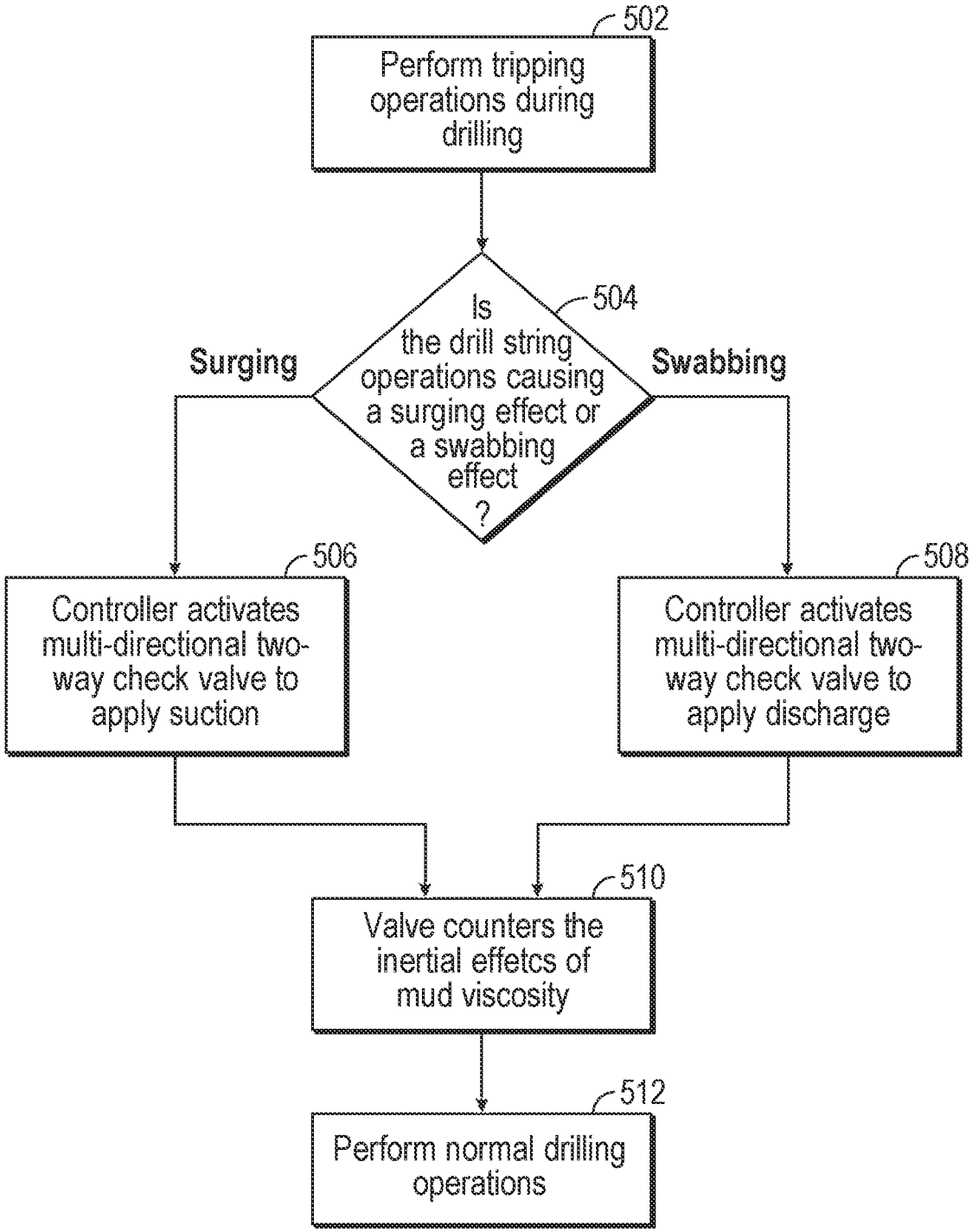
FIG. 6 shows a flow chart in accordance with one or more embodiments.

FIG. 6 shows a flow chart in accordance with one or more embodiments. Specifically, the flowchart illustrates a method for counteracting surging and swabbing effects to perform normal drilling operations using two-way smart valves (300). Further, one or more blocks in FIG. 6 may be performed by one or more components as described in FIGS.

1-5. While the various blocks in FIG. 6 are presented and described sequentially, one of ordinary skill in the art will appreciate that some or all of the blocks may be executed in different orders, may be combined or omitted, and some or all of the blocks may be executed in parallel. Furthermore, the blocks may be performed actively or passively.

Initially, the drilling rig (100) performs tripping operations (502). The drill string operations may cause surging effect (504). If surging effects (402) occur, the controller may then activate the valve(s) (506) to apply suction. The drill string operations may cause swabbing effect (504). If swabbing effects (404) occur, the controller may then activate the valve to apply discharge of fluids (508). Once the valves (300) are activated, the valve (300) counters the inertial effects of mud viscosity (510). Then, in turn, normal drilling operations can continue (512).

What is claimed is:

1. A system for well control during tripping phases in drilling operations in a wellbore, the system comprising:

a drill string extending from an entry of the wellbore to a drill bit at a distal end of the drill string within the wellbore;

a near bit sub mounted along the drill string adjacent to the drill bit;

a first multi-directional two-way check valve mounted along the drill string adjacent to the near bit sub, wherein the valve comprises:

a main body containing a shuttle;

a primary inlet connected to the main body;

a secondary inlet connected to the main body; and an outlet connected to the main body, wherein the shuttle is moved by a pressure differential of the primary inlet and secondary inlet so as to control which of the primary inlet or secondary inlet is connected to the main body, wherein which one of the primary inlet or the secondary inlet is connected to the main body controls whether suction or discharge flow is applied; and a controller configured to operate the valve, wherein the controller controls the valve to apply suction or discharge flow to the near bit sub to counter inertial effects of drilling mud viscosity within the wellbore.

2. The well control system of claim 1 further comprising:

a plurality of multi-directional two-way valves mounted inside the near bit sub facing the wellbore, wherein each of the plurality of valves is controlled to apply suction or discharge flow to the near bit sub so as to counter inertial effects of mud viscosity in the wellbore by migrating fluids towards a direction.

3. The well control system of claim 2, wherein the near bit sub comprises an annulus that has an inner diameter smaller than an outer diameter that contains the plurality of valves.

4. The well control system of claim 3, wherein each of the plurality of valves is disposed around the annulus spaced equally apart from each other.

5. The well control system of claim 1, wherein the outlet connects from the main body to spring brakes, wherein which one of the primary inlet or the secondary inlet is connected to the main body controls whether the spring brakes are activated or not.

6. The well control system of claim 1, wherein the valve is sealed in the near bit sub in the drill string.

7. The well control system of claim 1, wherein the controller operates the valve mechanically.

8. The well control system of claim 7, wherein the valve can be activated by sheer pressure surrounding the drill string.

9. The well control system of claim 8, wherein the valve can be activated by the controller depending on a returning data feed from a well control room.

10. The well control system of claim 9, wherein the controller operates the valve based on sheer pressure reading from the wellbore.

11. The well control system of claim 1, wherein drill string further comprises a solid;

wherein a portion of the drill string that contains a device which allows movement of the solid to cause an inner sealing of the valve to block flow to the wellbore and only allow fluid exchange to occur upon necessity by moving the solid out of the portion of the drill string.

12. The well control system of claim 11, wherein the solid is sent through high pressure to be seated in a median position when the valve has been activated and pressure has been equalized.

13. The well control system of claim 12, wherein the solid securing the valve from inside of the drill string so as to allow the drill string to perform normal drilling operations.

14. The well control system of claim 11, wherein the solid is hollow and covered in a seal to allow the solid to be pushed near a valve system.

15. A method, comprising:

controlling, by a controller, a multi-directional two-way check valve for tripping phases during drilling, wherein the tripping phases comprise of surging effects, wherein the valve is mounted along a drill string adjacent to a near bit sub on the drill string adjacent to a drill bit, wherein the valve comprises:

a main body containing a shuttle;

a primary inlet connected to the main body;

a secondary inlet connected to the main body; and an outlet connected to the main body, wherein the shuttle is moved by a pressure differential of the primary inlet and secondary inlet so as to control which of the primary inlet or secondary inlet is connected to the main body, wherein which one of the primary inlet or the secondary inlet is connected to the main body controls whether suction or discharge flow is applied;

controlling, by the controller, the multi-directional two-way check valve for tripping phases during drilling, wherein the tripping phases comprise of swabbing effects;

applying, by the valve, suction to counter inertial effects of mud viscosity in a wellbore; and applying, by the valve, discharge flow to counter inertial effects of mud viscosity in a wellbore.

16. The method of claim 15, wherein the valve comprises of a solid between outputs of the valve.

17. The method of claim 15, wherein controlling the valve comprises:

Operating mechanically to allow fluids to migrate in a single direction at a time;

Operating remotely through well control instrumentation to allow fluids to migrate in a single direction at a time;

Activating the valve by sheer pressure from a well formation and a strata surrounding a drill string; and Activating the valve based on returning data feed from commands transmitted from a well control room.

18. A method for well control during tripping phases in drilling operations using a drill string extending from an entry of a wellbore to a drill bit at a distal end of the drill string within the wellbore, the method comprising:

mounting a near bit sub along the drill string adjacent to the drill bit;

mounting a first multi-directional two-way check valve along the drill string adjacent to the near bit sub; and controlling, by a controller, operation of the valve to apply suction or discharge flow to the near bit sub to counter inertial effects of drilling mud viscosity within the wellbore, wherein the valve comprises:

a main body containing a shuttle;

a primary inlet connected to the main body;

a secondary inlet connected to the main body; and an outlet connected to the main body, wherein the shuttle is moved by a pressure differential of the primary inlet and secondary inlet so as to control which of the primary inlet or secondary inlet is connected to the main body, wherein which one of the primary inlet or the secondary inlet is connected to the main body controls whether suction or discharge flow is applied.

19. The method of claim 18 further comprising:

mounting a plurality of multi-directional two-way valves inside the near bit sub facing the wellbore; and controlling, by a controller, each of the plurality of valves to apply suction or discharge flow to the near bit sub so as to counter inertial effects of mud viscosity in the wellbore by migrating fluids in a single direction.

* * * * *